US007337853B2

(12) United States Patent
Buytaert et al.

(10) Patent No.: US 7,337,853 B2
(45) **Date of Patent: *Mar. 4, 2008**

(54) TOP FEED OF CONTROL LINES TO A RECIPROCATING SPIDER

(75) Inventors: Jean Buytaert, Newtonhill (GB); Luciano Spadoni, Mezzano-Ravenna (IT); Edward Sinclair, Stonehaven (GB); Brian David Begnaud, Youngsville, LA (US); Charles Michael Webre, Lafayette, LA (US)

(73) Assignee: Frank's International, Inc., Houston, TX (US)

( * ) Notice: Subject to any disclaimer, the term of this patent is extended or adjusted under 35 U.S.C. 154(b) by 96 days.

This patent is subject to a terminal disclaimer.

(21) Appl. No.: 11/328,842

(22) Filed: Jan. 10, 2006

(65) Prior Publication Data

US 2006/0108122 A1 May 25, 2006

Related U.S. Application Data

(63) Continuation-in-part of application No. 11/114,630, filed on Apr. 26, 2005, now abandoned, which is a continuation of application No. 10/278,718, filed on Oct. 23, 2002, now Pat. No. 6,889,772.

(51) Int. Cl.
*E21B 19/02* (2006.01)

(52) U.S. Cl. ..... 166/381; 166/77.52; 175/52

(58) Field of Classification Search ..... 166/381, 166/380, 77.51, 77.52, 77.53, 85.1; 175/52, 175/162, 189, 202
See application file for complete search history.

(56) References Cited

U.S. PATENT DOCUMENTS 3,722,584 A 3/1973 Nelson
3,722,603 A 3/1973 Brown
3,742,563 A 7/1973 Brown
4,106,575 A 8/1978 Bunnelle
4,274,778 A 6/1981 Putnam et al.
4,281,716 A 8/1981 Hall
4,450,606 A 5/1984 Broussard
4,715,625 A 12/1987 Shows et al.
4,938,109 A 7/1990 Torres et al.

(Continued)

FOREIGN PATENT DOCUMENTS

GB 296171 8/1928

(Continued)

OTHER PUBLICATIONS

International Search Report; International application No. PCT/US 03/33647; International filing date Oct. 23, 2003; 4 pages.

*Primary Examiner*—William P Neuder
(74) *Attorney, Agent, or Firm*—Patrick K. Steele; Streets & Steele

(57) ABSTRACT

Method and apparatus for installing control lines and pipe into a well. The pipe-holding spider that is normally mounted on the rig floor is supportably retained in a vertically movable retainer. The retainer is adapted for controllably elevating the spider above the rig floor when the pipe slips within the spider are not engaged with the outer surface of the pipe string, thereby providing personnel access to a portion of the length of the pipe string below the elevated spider and above the rig floor. Personnel are provided with access to the pipe string for applying a fastener to secure the control line to the pipe string. The control line is supplied from above the spider and is positioned by a control line guide supported on the spider or retainer to pass through the spider outside the path of pipe gripping members within the spider.

21 Claims, 8 Drawing Sheets

U.S. PATENT DOCUMENTS

| | | | | |
|---|---|---|---|---|
| 5,335,756 | A | 8/1994 | Penisson | |
| 5,503,234 | A | 4/1996 | Clanton | |
| 5,732,909 | A | 3/1998 | Sonnnier | |
| 6,089,338 | A | 7/2000 | Bouligny, Jr. | |
| 6,131,664 | A | 10/2000 | Sonnier | |
| 6,138,776 | A | 10/2000 | Hart et al. | |
| 6,279,662 | B1 | 8/2001 | Sonnier | |
| 6,443,241 | B1 | 9/2002 | Juhasz et al. | |
| 6,471,439 | B2 | 10/2002 | Allamon et al. | |
| 6,637,526 | B2 | 10/2003 | Juhasz et al. | |
| 6,889,772 | B2 | 5/2005 | Buytaert | |
| 2005/0161230 | A1* | 7/2005 | Webre et al. | 166/384 |
| 2006/0027375 | A1* | 2/2006 | Thomas et al. | 166/380 |

FOREIGN PATENT DOCUMENTS

| | | | |
|---|---|---|---|
| GB | 296171 | A | 8/1928 |
| WO | WO 00/19061 | | 4/2000 |

* cited by examiner

TOP FEED OF CONTROL LINES TO A RECIPROCATING SPIDER

This application is a continuation-in-part of U.S. patent application Ser. No. 11/114,630 filed on Apr. 26, 2005 now abandoned, which is a continuation of U.S. patent application Ser. No. 10/278,718 filed Oct. 23, 2002, now U.S. Pat. No. 6,889,772.

BACKGROUND OF THE INVENTION

1. Field of the Invention

The present invention relates to a method and apparatus for installing pipe and a control line in a well. More specifically, the present invention relates to a method and apparatus for securing a control line to a string of pipe as the pipe is being made up and run into a well.

2. Background of the Related Art

Wells are generally drilled deep into the earth's crust to establish fluid communication between the surface and sub-surface geologic formations containing naturally occurring hydrocarbon deposits, such as oil or gas. A well provides a fluid conduit allowing subsurface deposits of oil and gas to be produced at the surface. It is common for a drilled borehole to penetrate a plurality of formations. Formations may contain hydrocarbons or other fluids of different compositions and at different pressures than the hydrocarbons and fluids contained in other formations. Formations may also contain water (aquifers), brine, hydrogen sulfide gas and other materials that may be undesirable.

A drilled borehole is completed into a well by circulating cement into the annulus between the wall of the drilled borehole and the outer surface of a pipe string called casing to form a cement liner. The cement hardens to isolate penetrated formations from flowing into the well and to the surface. Once a borehole is drilled and completed, decisions are made as to which of the penetrated formations to selectively produce. A perforating tool is used to cut a hole through the casing and the cement liner to selectively establish fluid communication between the targeted formation and the surface. Once a formation is perforated, the well may be produced to (pressure) depletion, until it "waters out" by increasing water content, or both. Once a formation is depleted or watered out, it may be desirable to intervene in the well to alter or isolate the formation so that other formations may be perforated and produced without the production being burdened by fluid losses into depleted formations or by water intrusion from watered-out formations. Intervention is generally performed by wire line unit (WLU) workover, coiled tubing unit (CTU) workover or by a conventional workover rig. A WLU or CTU workover is performed by lowering an instrument or tool into the well using a specialized rig having a long spooled wire line or tubing for connecting or controlling the downhole instrument or tool from the surface. The conventional workover rig generally requires that all production tubing be removed from the well so that tools or instruments may be run into the well on a work string.

If the depleted or watered-out formations are lower in the well than the formation, the depleted or watered-out formation may be isolated from the well by using one of the three conventional intervention techniques described above. In a conventional intervention workover, material such as cement or sand may be deposited into the bottom of the well to form a plug to seal off the perforations in the depleted or watered-out formation, and to thereby isolate the depleted or watered-out formation from the new formation located above. Once a sand or cement plug is in place, another workover may be required to later remove it. Packers are tools that can be installed in a well during a workover to isolated, depleted or watered-out formations.

Conventional workovers to install or remove downhole plugs or packers are unnecessary if formations can be isolated or remotely controlled using downhole devices. Downhole devices, such as valves or chokes, may be installed in a pipe string as it is being made up and run into a well to enable the selective production, isolation or flow-control of fluids residing in the formations penetrated by a well. Surface-controlled downhole valves or chokes require continuous control lines that extend from the surface through the well to the depth at which the downhole devices are installed in the pipe string. Control lines must be installed as the pipe string is being made up and run into the well.

Continuous control lines are generally stored and transported to the rig location on spools. The spools of control line are generally mounted on a horizontal axle on or near the rig floor so that the control line may be easily and smoothly "fed" to and fastened to the pipe string by reeling of the spool.

Oil and gas wells may be equipped with control lines for electrically, hydraulically or optically linking various downhole devices to the surface. Control lines may be used to receive data from downhole instruments and to selectively operate from the surface downhole devices such as valves, switches, sensors, relays or other devices. One use of control lines is to open, close or adjust downhole valves in order to selectively produce or isolate formations at locations deep in the well. A control line may transmit downhole data to the surface and communicate commands to the same or other downhole devices. The control line may comprise conductive wires or cables for electrically controlling downhole devices, fibers for optically controlling downhole devices, or small-diameter tubing for hydraulically controlling downhole devices. Control lines are generally of a small diameter relative to the diameter of the pipe string to which they are secured, and are generally between 0.5 and 6 cm in diameter. Control lines may be bundled to make a single umbilical with diameters of 10 cm or more. Control lines are generally secured along the length of the outer surface of a pipe string, generally parallel to the center axis of the bore of the pipe string. Continuous control lines are secured to the pipe string and installed in the well as joints of metal pipe are made up into a pipe string and run into a well. Control lines secured to pipe string are subject to being damaged and made useless if pinched or crushed by pipe slips used to grip and support the pipe string, such as during the process of making up the pipe string and running it into the well.

A spider is a device used on a drilling or workover rig for gripping and supporting the pipe string as joints of pipe are made up into the pipe string. The spider has an interior bore, generally aligned with the pipe string, through which the pipe string passes. The spider has a circumferential arrangement of radially inwardly movable pipe slips disposed around the pipe string and within the internal bore. The pipe slips move radially inwardly to grip the outer surface of the pipe string and support the pipe string in the well when the pipe string is not supported by the lift elevator. It is important that the pipe slips in the spider uniformly engage and grip the pipe string in order to prevent crushing or damaging the pipe making up the pipe string. Each pipe slip within the internal bore of the spider applies a force radially inwardly against the outer surface of the pipe string. It is important that the pipe slips are concave around the pipe in order to contact the pipe over as large an interval as possible in order to minimize the localized stress imposed on the pipe by the pipe slips.

If a control line becomes pinched or trapped between the pipe slips of the spider and the outer surface of the pipe string, or if a control line is pinched between adjacent segments of the pipe slips as they move around and radially inwardly to contact the pipe string, the control line may be damaged and surface control of downhole devices or data transfer from downhole instruments may be lost or impaired. It is important that the method used to secure control lines to the pipe string be designed to prevent control line damage.

In many installations, it is desirable to secure multiple control lines along the length of the outer surface of the pipe string in order to allow surface control of multiple downhole devices. For example, the tools and other control valves or instruments requiring control lines may be made up into the pipe string at various depths, and the number of control lines at any given point on the pipe string depends on the location of that point in the pipe string. Multiple control lines are especially useful in deep offshore wells that penetrate multiple formations. Existing designs may require four or more control lines for each string of pipe that is run into the well. Multiple control lines are most efficiently made, stored, transported and installed in bundles comprising control lines coupled together in a generally parallel, side-by-side configuration. Multiple control lines may require larger clamps to secure the bundle along the length of the outer surface of the pipe string.

A method has been developed for securing control lines to a pipe string as the pipe string is made up and run into a well. U.S. Pat. No. 6,131,664 ("the '664 Patent") is directed to using an elevated work platform constructed on the rig floor. The work platform is equipped with hydraulic tongs for making up the pipe string, and an opening above the well in the floor of the work platform that is generally aligned with the well and with an opening in the rig floor beneath the work platform. The work platform disclosed in the '664 Patent supports the spider and, when the pipe string is supported by the spider, the work platform must support the weight of entire pipe string. This requires the work platform to be built to support 200 tons or more. The work platform described in the '664 Patent must also provide sufficient work area for rig personnel to use the tongs to make up joints of pipe that are lowered and aligned in position above the pipe string to be threadably made up into the pipe string.

The '664 Patent discloses that control lines are provided to the pipe string from a separate work area maintained on the rig floor and below the level of the work platform. The control lines are stored on and continuously provided from spools located lateral to the pipe string and adjacent to the opening in the rig floor. Clamps are installed by rig personnel working in the work area beneath the work platform to secure the control lines to the pipe string. One problem with the method and apparatus for installing control lines described in the '664 Patent is that the control lines and spools themselves take up a significant area of the rig floor and present an obstacle to various operations.

What is needed is a method of safely securing control lines to a pipe string as the pipe string is being made up and run into a well. What is needed is a method and an apparatus that enables the safe and inexpensive installation of control lines that are being secured to a pipe string as it is made up and run into a well. What is needed is a method of securing control lines along the length of a pipe string as it is being made up and run in a well that eliminates obstructions to escape routes to be used by rig personnel in the event of a well blowout or other well control situation.

SUMMARY OF THE PRESENT INVENTION

The present invention utilizes a spider that is supported in a retainer that is elevatable above a rig floor. The spider comprises a spider body and a plurality of gripping members or slips received within a tapered bowl in the spider body. The spider may also comprise or cooperate with control line guides for directing the pathway of control lines that pass through the spider body. For purposes of this disclosure, a control line guide is a device that rollably or slidably imparts a desired pathway to control line.

In one embodiment, a passage within the spider body may receive an elongated control line sleeve for containment and protection of one or more control lines from pinching or crushing between slips, or between slips and the pipe string secured by the slips. The elongated control line sleeve has an opening at each end is also received and may be secured within the spider body with one opening disposed upwardly and the other opening disposed downwardly. The control line sleeve may assist in directing and positioning the control lines along the pipe for coupling thereto. Optionally, the sleeve may be secured to any structural member and suspended or supported within the spider. Alternatively, the sleeve may be secured directly to the spider, such as the tapered bowl of the spider or the spider door. The sleeve must also be selectively openable, such as with a slot in one side, in order to receive a control line or to permit the withdrawal of a control line.

In another embodiment, the spider components form or may be manipulated to form a control line passage that is isolated from the slips and the pipe. Such a passage may be formed between the control line gate and spider door. In one embodiment, the control line is positioned in, or removed from, the passage by opening a spider door and a control line gate. In an alternate embodiment, the control line may be positioned in or removed from the passage by opening only the control line gate or only the spider door. The spider door is also opened for the spider to receive or to allow removal of a pipe string. Still further, while the control line passage itself will prevent contact between the control line and the slips, the control line passage may further include a sleeve, such as a one-part or two-part sleeve, to reduce abrasion to the sides of the control line. The control line passage and any sleeve used in cooperation with the passage must be selectively openable in order to receive a control line or to permit withdrawal of a control line. With a pipe string positioned within the spider, the passage and any sleeve is generally prevented from opening radially inwardly, such that the gate or sleeve must be opened by raising, lowering or opening radially outwardly by supporting the pipe string with the lift elevator so that the spider door can be opened.

In an alternate embodiment, the spider has a control line passage formed therein by disposing a slidable or selectively positionable control line gate between the pipe string and one of the spider door or the spider body so that the control lines are retained within the control line passage. The control line gate is positionable to form the control line passage even with the pipe string extending through the spider and with the spider door closed. This selective positionability of the control line gate provides a major operational advantage in that a control line can be run through the spider and protected from the pipe string and the slips without having to open the spider door. Accordingly, the control line gate may be positioned while the pipe string is being supported by either the lift elevator or the spider.

The control line gate is preferably positioned by inserting it with one side facing the pipe string and another side facing the contained control lines and at least one of the spider body or the spider door, or a combination of both. The control line gate is preferably also inserted from the top. After insertion, the control line gate is secured in position. The control line gate is preferably secured to the spider body, the spider door, or a combination thereof. Alternatively, the control line gate may be secured or suspended in position from some other structure, such as an assembly securing the control line guides. In a most preferred embodiment, the control line gate has two edges that are slidingly received in a pair of slots formed in the inner face of the spider body or the spider door so that the control line gate can be lifted out of the slots for receiving an additional control line within the passage and then reinstalled into the slots with all the control lines retained in the passage. As used herein, a "slot" may refer to a slot, track, guide, ridge or any feature that facilitates sliding engagement and coupling.

The control lines are fed to the well from generally above the spider. The control lines are routed from a spool and may engage one or more guides adapted for being rollably secured to the spider body. The roller guides direct the control line into an upwardly disposed opening in the spider, through a passageway that is unobstructed by the slips and downwardly along the length of the pipe string into the borehole. If a control line protective sleeve is being used in association with the spider, then the roller guides direct the control line into an upwardly disposed end of protective sleeve, through the elongated sleeve and out of the downwardly disposed opening of the sleeve. The exposed portion of the pipe string and control line between the elevated table and the rig floor provides a clamping zone where clamps can be installed to secure the control lines to the exterior surface of the pipe string.

The method and apparatus of the present invention allows one or more control lines to be secured along the length of a pipe string as the pipe string is being made up and run into a well. The method and apparatus of the present invention allows control lines to be secured to a pipe string above the rig floor and below the spider, but eliminates the need for an elevated work platform strong enough to support the enormous weight of the pipe string. The method and apparatus of the present invention improves rig safety and operation by top-feeding the control line through the spider and preventing impairment of escape routes on the rig floor.

In the preferred method and apparatus of the present invention, the spider is received within and supportable by a vertically reciprocating retainer. The retainer is adapted to distribute the load on the spider to structural components in or under the rig floor when the pipe string is supported by the spider, and to vertically displace and support the spider when the spider is disengaged from the pipe string and the weight of the pipe string is supported by the lift elevator, with or without a top drive which may, for example, form part of a casing running tool. Alternatively, the spider may be directly supported by the rig floor when supporting the pipe string, yet be supported by the retainer for elevation above the rig floor. The disengaged spider may be controllably elevated using the retainer to support the spider at a distance above the rig floor to permit rig personnel access to the outer surface of the portion of the pipe string located below the elevated spider and above the rig floor. Access to the outer portion of the pipe string below the spider and above the rig floor permits rig personnel to install fasteners to secure control lines to the pipe string.

According to the presently preferred embodiment, a control line is provided to the pipe string from above the spider. Preferably, the spool may be positioned at a remote location on the rig floor and the control line passed up and over an elevated sheave or pulley so as to come downwardly to the spider. The spool may be rotatably mounted in a fixed location that is a sufficient distance above the spider and in sufficient proximity of the axial centerline of the pipe string to provide a favorable approach angle. The control line should not be bent or deflected at an angle exceeding manufacturer recommendations as the control line is fed downwardly to and into the spider. Preferably, the angle formed between the control line and the pipe string will not exceed about 60 degrees, and more preferably, will not exceed about 45 degrees. Rollers, pulleys or sheaves may be used to limit localized bending of the control line. The control line may be routed or threaded over a roller guide secured above the spider to strategically direct the top-fed control line from the spool through the spider and along the length of the pipe string so that the control line can be secured to the pipe string. The control line is secured to the pipe string with fasteners, such as clamps, sleeves, bands, clips or other fasteners at a position beneath the elevated spider, but in the adjacent area of the rig floor. The control line may be secured along the outer surface of the pipe string at any radial or circumferential location of the pipe string below the spider, but the control line is preferably secured along the outer surface of the pipe string at a radial or circumferential location that is generally aligned with the passage through the spider. Accordingly, the control line passes through the spider without being damaged by the pipe slips within the internal bore of the spider.

It should be recognized that a plurality of control lines may be supplied to the pipe string in accordance with the present invention. Multiple control lines may be supplied as a bundle or they may be supplied separately.

Advantageously, the fasteners or clamps used to secure control lines to the pipe string may be designed independent of restrictions imposed by the size or configuration of the internal bore of the spider. The fasteners may be secured at any desired spacing along the length of the pipe string, such as one fastener per joint of pipe. It is specifically anticipated that multiple fasteners may be used along the length of a single joint of pipe and single stand of pipe, or that entire joints or stands of pipe may be skipped.

In a still further embodiment, the invention provides a method comprising the steps of securing an instrument to a pipe string, wherein the instrument includes a control line extending therefrom, lowering the pipe string so that the instrument and control line pass through a spider having a plurality of pipe gripping members, and positioning a control line gate to separate the control line from the pipe gripping members. Preferably, the control line gate also separates the control line from the pipe string. Most preferably, the steps can be repeated to receive a plurality of control lines as additional instruments or controlled devices are made up and run into the wellbore.

The foregoing, as well as other, objects, features, and advantages of the present invention will be more fully appreciated and understood by reference to the following drawings, specification and claims.

DETAILED DESCRIPTION OF PREFERRED EMBODIMENTS

Figure 1A:
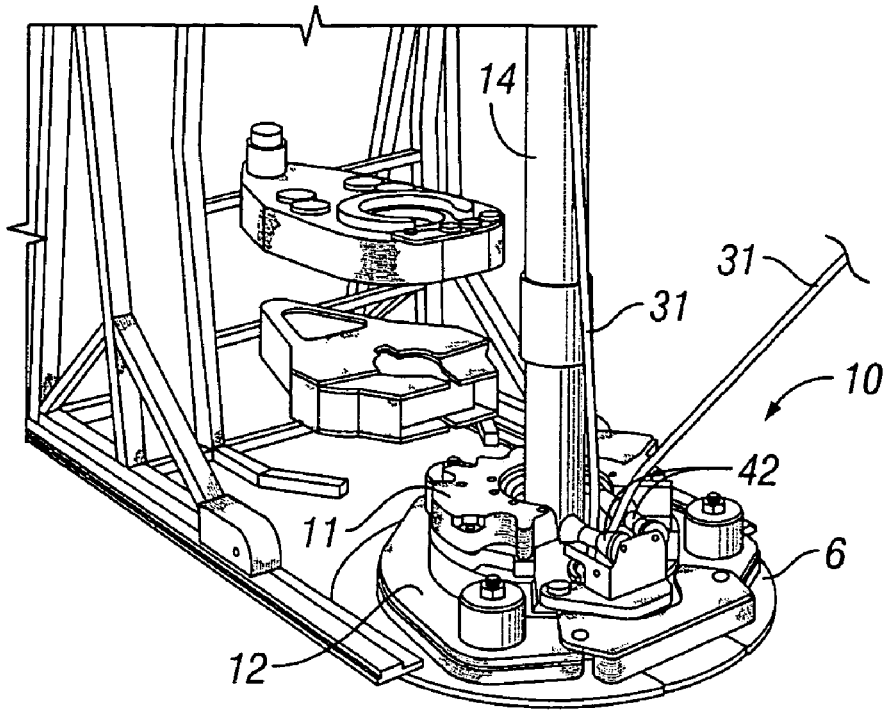
FIG. 1A is a perspective view of a vertically reciprocating spider assembly in its floor position with a spider received in a reciprocating retainer and control line guides directing top-fed control lines through a passage within the spider and along the pipe string.

FIG. 1A is a perspective view of one embodiment of a vertically reciprocating spider assembly 10 in its floor position with a spider 11 received in a reciprocating retainer 12 and control line guides 42 directing top-fed control lines 31 through the spider and downwardly along the length of the pipe string 14. The retainer 12 may be integral with the spider 11 or it may be a separate device adapted to supportably receive the spider 11.

Figure 1B:
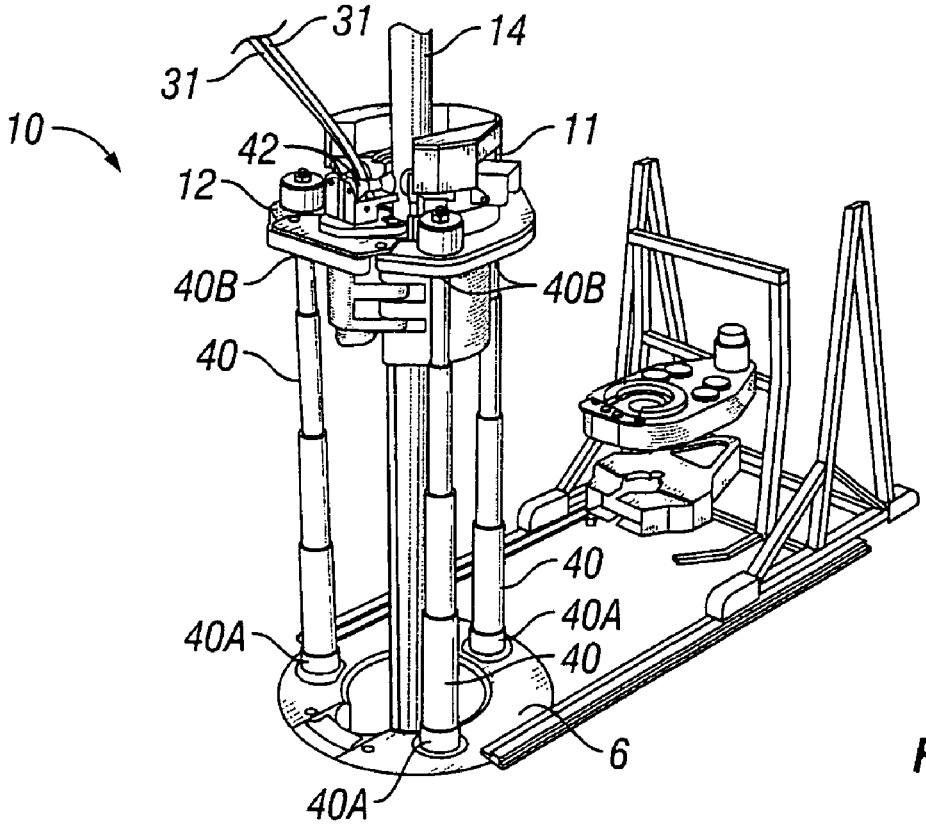
FIG. 1B is a perspective view of the vertically reciprocating spider assembly in an elevated position to facilitate fastening of the control line to the pipe string.

FIG. 1B is a perspective view of the vertically reciprocating spider assembly 10 supporting the spider 11 in an elevated position to facilitate fastening of the control lines 31 to the pipe string 14. The retainer 12 is supportable with three hydraulically powered telescoping legs 40 angularly distributed around the periphery of the retainer 12 for even support. Any number of legs may be used so long as the spider is stable and the legs 40 do not significantly impede access to the pipe string for fastening the control lines. The legs 40 are designed to telescope and retract in unison for smooth and controlled elevation and return of the retainer 12 and the spider 11 supported in the retainer 12. Each leg 40 is coupled at a stationary end 40A to the rig floor 6 or other structural component of the rig, and coupled at a traveling end 40B to the retainer 12. Control lines 31 are provided to the retainer 12 from spools (not shown) located above the spider and lateral to the pipe string 14. Each control line 31 engages a roller guide 42 supported above the spider near the internal bore of the spider 11 to direct the control line to generally lay flat along the length of the outer surface of the pipe string 14. It should be noted that a variety of tools or devices may be used in place of or in cooperation with the roller guides 42 to bend and direct the control lines 31 to their intended pathway or configuration for being secured to the pipe string 14 and run into the well. Persons skilled in the art will appreciate that a control line guide may include the use of shaped guides, roller guides, cable funnels, slides, and the like, either alone or in combination, to position and configure the pathway of control lines.

Figure 1C:
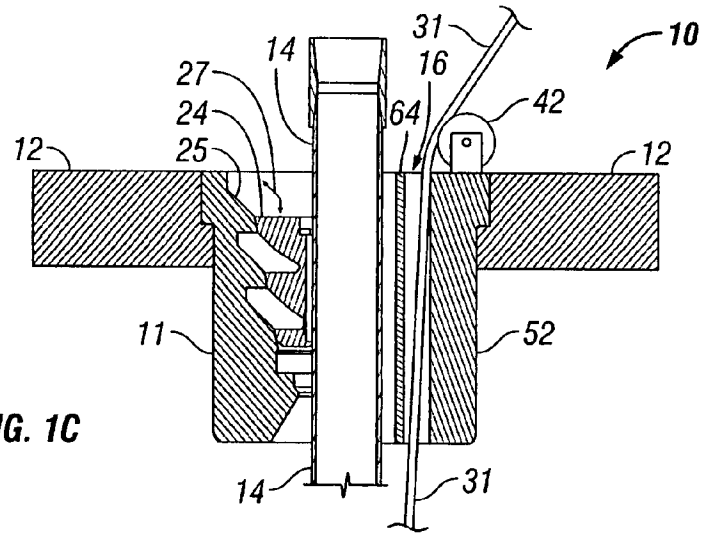
FIG. 1C is a cross-sectional side view of the vertically reciprocating spider assembly showing the spider slips and the control line passage through the spider.
Figure 1D:
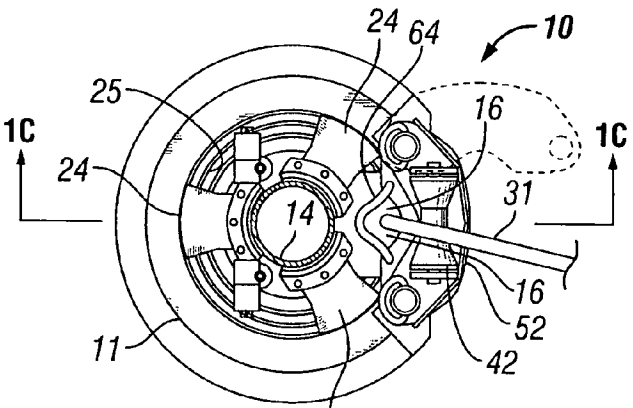
FIG. 1D is a schematic top view of the vertically reciprocating spider assembly showing the control line gate received by the spider door to form the control line passage outside the path of the spider slips.
Figure 1E:
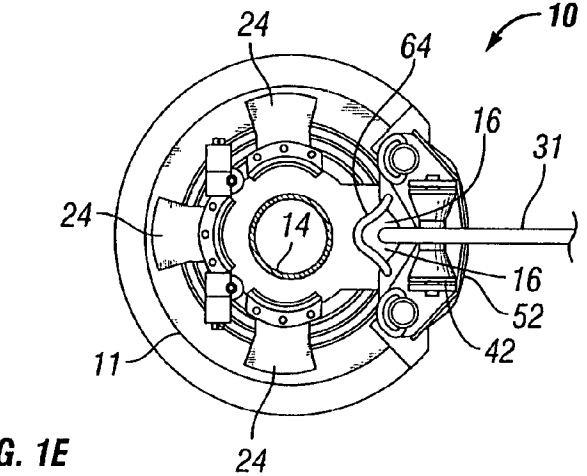
FIG. 1E is a schematic top view of the vertically reciprocating spider assembly showing the spider slips in their disengaged position.

FIGS. 1C, 1D and 1E include a schematic cross-sectional side view and two top views, respectively, of the vertically reciprocating spider assembly 10 showing the spider slips 24 and a control line passage 16 through the spider 11 outside the path of the slips. More particularly, the control line passage 16 is disposed within the spider, but outside the path or range of motion of the spider slips as they open and close around the pipe string. The pipe slips 24 are disposed within the spider 11 in a generally radially distributed arrangement within the internal bore 25 of the spider 11. The pipe slips 24 are downwardly and radially inwardly movable (see arrow 27) to forcibly engage the outer surface of the pipe string 14 to grip and support the pipe string 14 when the weight of the pipe string 14 is not supported by the lift elevator (not shown). Still, the slips 24 move along a path between an engaged position (see FIG. 1D) and a disengaged position (see FIG. 1E) leaving room within the spider for a control line passage 16 that is outside the path of the slips. The spider should always be in its floor position when supporting the pipe string. While only one control line guide 42 is shown in FIG. 1C for clarity, additional control line guides may be used, such as those shown in FIGS. 1A, 1B and 9.

In FIGS. 1C, 1D and 1E, the spider assembly 10 may further include a control line gate 64 that extends generally vertically and generally along the slips 24 through the bore of the spider 11. The gate 64 may have various shapes and sizes, but serves to protect the control line 31 that passes through the passage 16. The control line gate prevents the control line from straying into a position where the control line could become pinched by the slips 24 as they engage the pipe string 14. Preferably, the control line gate provides a smooth interior surface that prevents abrasion or snagging of the control line.

Figure 1F:
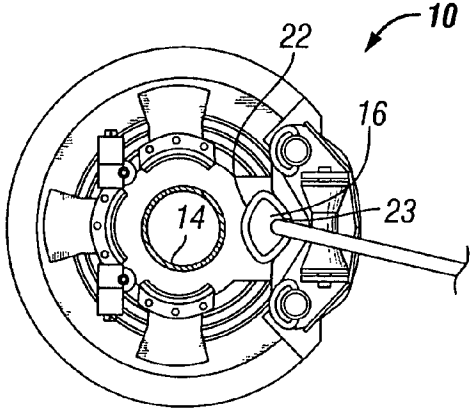
FIG. 1F is a schematic top view of the vertically reciprocating spider assembly showing a sleeve secured within the spider body to form the control line passage.
Figure 10:
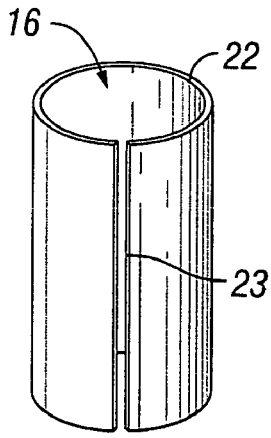
FIG. 10 is a perspective view of a simple sleeve having a cut along the length of the sleeve to receive a control line.

In FIG. 1F, an optional sleeve 22 can be used to form the control line passage 16 instead of the control line gate. The sleeve may be secured to the spider or to the retainer so that it reciprocates as a unit along with the spider, retainer and control line guide. Optionally, an existing spider door may be replaced with a new spider door having the control line guides and a sleeve coupled to it or formed in it. The sleeve is preferably a smooth metal tube, but it may also be a rigid or resilient polymer material. Preferably, the sleeve extends a sufficient distance to protect the control line from substantially all potential pinch-points, abrading surfaces and the like before allowing the control line to exit along the pipe string below the spider. The sleeve can also serve the function of directing the control line into a desired alignment or position about the pipe string, especially if the upper end extends above the spider at an appropriate angle to receive the control line. For a number of operations, it is beneficial for the sleeve to be openable and closable from the side so that a control lines can be secured within the sleeve without requiring threading of the control line therethrough. As shown in FIG. 10, an elongated gap 23 along the length of the sleeve may serve this purpose, but both edges of the elongated gap should be securable so that the control line does not inadvertently exit the sleeve.

Figure 2:
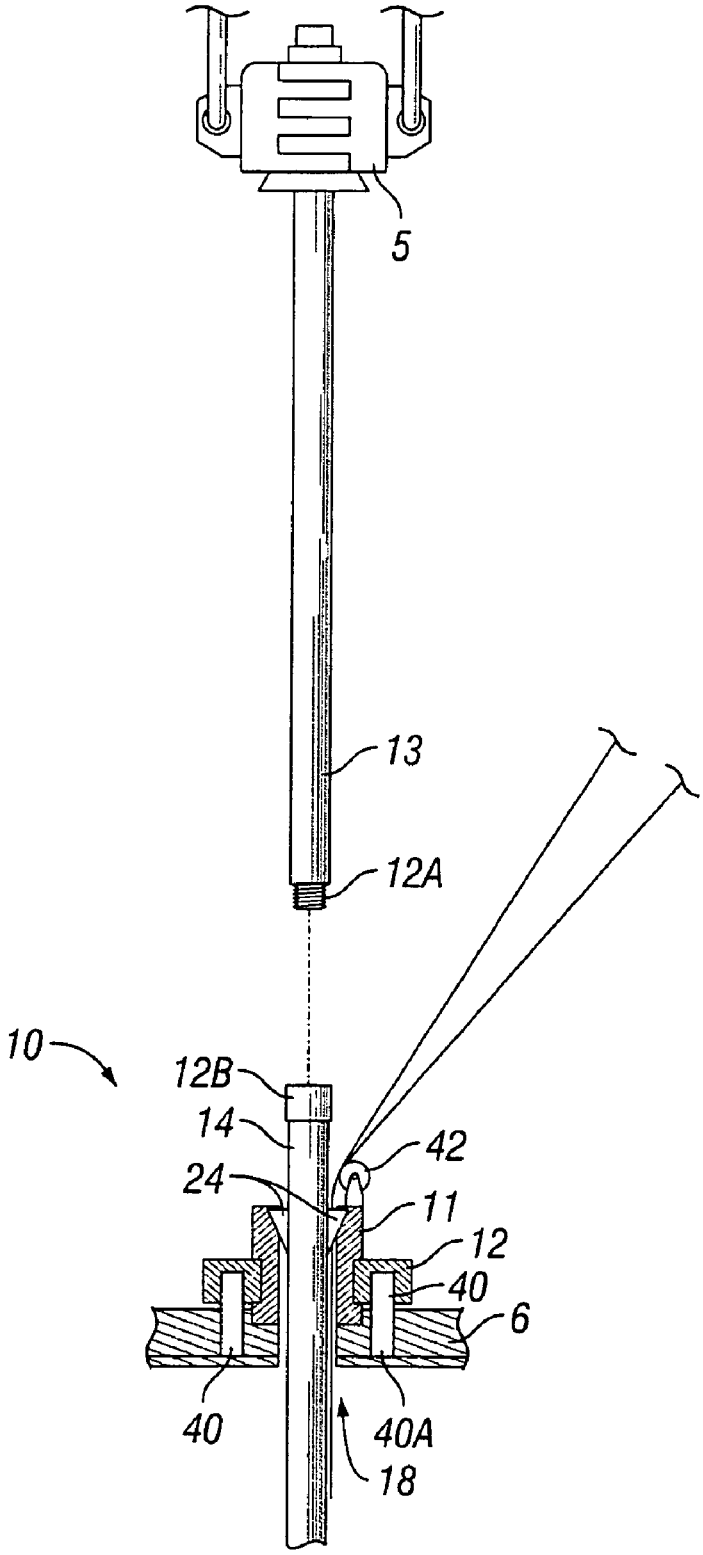
FIG. 2 is a side elevational view of the vertically reciprocating spider assembly of the present invention, with a spider received in a reciprocating retainer, in its floor position as a joint of pipe supported by the lift elevator is aligned with the pipe string and lowered to be threadably coupled to the pipe string.

FIG. 2 is a side elevational view of one embodiment of the vertically reciprocating spider assembly 10 of the present invention, with a spider 11 received in a reciprocating retainer 12, and in its floor position as a joint of pipe 13 supported by the elevator 5 is aligned with the pipe string 14 and lowered to be threadably coupled to exposed end of the pipe string. A rig floor 6 supports the vertically reciprocating retainer 12 that, in turn, supports the spider 11. Alternatively, the spider may be directly supported by the rig floor when supporting the pipe string, yet supported by the retainer for elevation above the rig floor. The spider 11 rests in and is supported in the retainer 12, and the retainer 12 is adapted to be vertically elevated and supported by one or more telescoping legs 40. The legs 40 controllably vary in length to controllably elevate the retainer 12 to its raised or elevated position above the rig floor 6.

To makeup a joint of pipe, the joint of pipe 13 having a downwardly disposed threaded male connection 12A is supported by the elevator 5 and lowered into position to be threadably coupled to the pipe string 14. The threaded male connection 12A is received and screwed into the threaded coupling 12B coupled to the upwardly exposed end of the pipe string 14.

Personnel working on the rig floor 6 may employ either a hydraulically-powered set of tongs or a top drive (not shown) to apply make-up torque to the pipe 13 and the male connection 12A and threadably couple it to the threaded coupling 12B to join pipe 13 into the pipe string 14. The rig floor 6 immediately adjacent to the retainer 12 provides a work area for rig personnel operating the hydraulic tong assembly to torque up the pipe string 14 by sequentially coupling additional joints of pipe 13.

Figure 3:
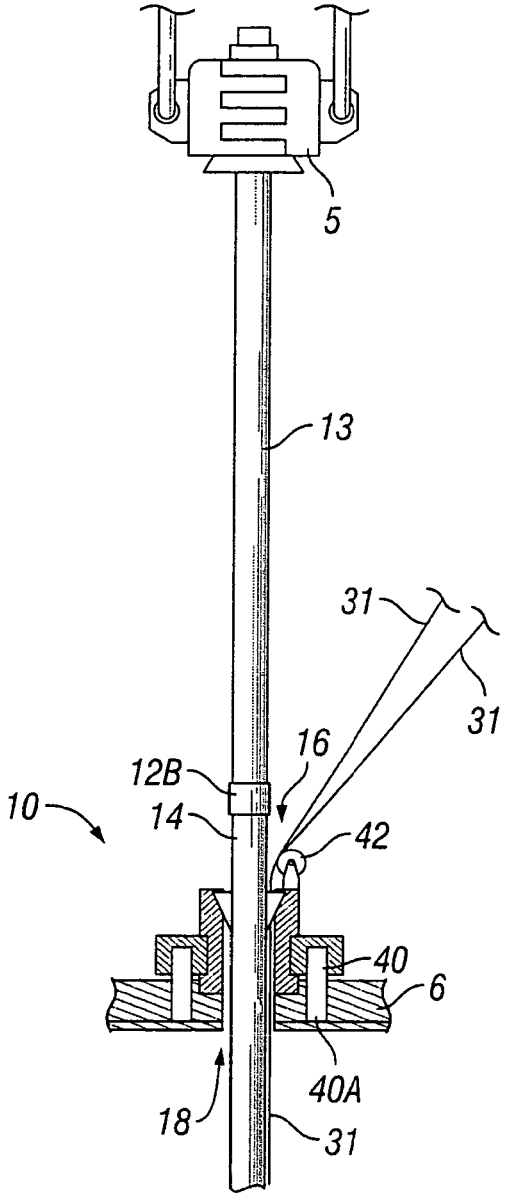
FIG. 3 is a side elevational view of the vertically reciprocating spider assembly of the present invention, with a spider received in a reciprocating retainer, in its floor position with the pipe string supported by the lift elevator after the pipe slips in the bore of the spider are disengaged from the outer surface of the pipe string.

In the preferred embodiment of the present invention shown in FIGS. 2-6, the retainer 12 is movably supported by three or more hydraulically telescoping legs 40 (only two are shown). The legs 40 are designed to position the retainer 12 in its floor position (as shown in FIGS. 2 and 3) for engaging the pipe slips 24 of the spider 11 with the pipe string 14. When the pipe string 14 is supported by the elevator 5, the legs 40 may telescope to elevate or raise the retainer 12 and the spider 11 supported therein to the intermediate position (shown in FIG. 4) and, at the extreme length, to support the retainer 12 and the spider 11 in the raised position (shown in FIG. 5). The horizontal spacing between adjacent legs 40 shown in FIGS. 2-6 provides generally rectangular openings through which the operator may access the control lines 31 and the pipe string 14 for attaching a clamp or fastener before advancing the pipe string further through the opening 18 in the rig floor 6.

FIG. 3 is a side elevational view of the preferred embodiment of the vertically reciprocating spider assembly 10 of the present invention in its floor position with the pipe string 14, now comprising the pipe 13, supported by the elevator 5 after the pipe slips 24 in the internal bore of the spider 11 are disengaged from the outer surface of the pipe string 14. The control lines 31 are threaded over the control line guide 42 and strategically directed downwardly through the passage 16 between the spider and the pipe string and along the length of the pipe string 14.

Figure 4:
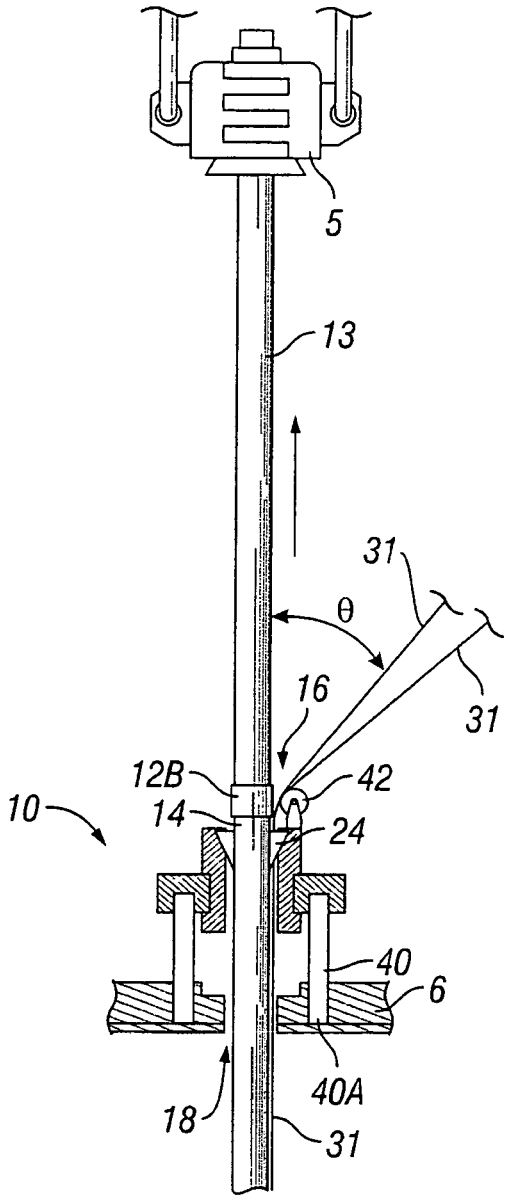
FIG. 4 is a side elevational view of the vertically reciprocating spider assembly of the present invention, with a spider received in a reciprocating retainer, with the pipe slips disengaged from the outer surface of the pipe string and the retainer and spider partially elevated from the floor position towards the raised position.
Figure 5:
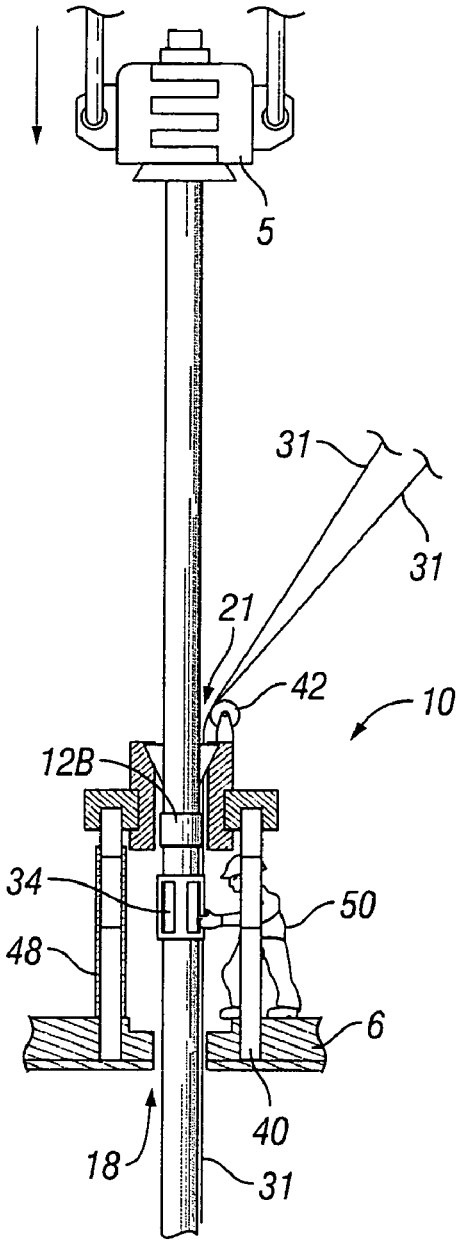
FIG. 5 is a side elevational view of the vertically reciprocating spider assembly of the present invention, with a spider received in a reciprocating retainer, with the vertically reciprocating spider retainer supporting the spider in an elevated position providing rig personnel access to a portion of the length of the pipe string below the spider and above the rig floor for installing a control line fastener or clamp to secure the control line to the pipe string.

The legs 40 that support and raise the retainer 12 are adapted for imparting generally vertical displacement of the retainer 12 and the spider 11 when the pipe slips 24 of the spider 11 are disengaged from the pipe string 14. In the preferred embodiment, the legs 40 comprise hydraulically telescoping members such as those generally used in hydraulic jacks and lifts. The hydraulic power for telescoping the legs 40 to raise the retainer (as shown in FIGS. 4 and 5) may be provided by the same hydraulic fluid and pump system used to operate the power tongs or other rig equipment. Alternately, the retainer 12 may be raised and lowered using any of a variety of mechanical jacks generally known to those skilled in the mechanical arts for imparting vertical displacement of heavy objects. One alternative jack may include legs 40 that are threaded along their length and threadably coupled to the retainer 12 to impart movement of the retainer 12 by axial rotation of the legs 40, such as with a screw jack. Another alternative jack may include a scissor-lift mechanism for raising the retainer 12. Other alternatives of the present invention may provide a means of lifting the retainer 12 and spider 11 using the elevator 5, which would necessarily also be supporting the entire weight of the pipe string 14.

FIG. 4 is a side elevational view of the preferred embodiment of the vertically reciprocating spider assembly 10 of the present invention, with the pipe slips 24 disengaged from the outer surface of the pipe string 14 and shown as the retainer 12 and the spider 11 are elevated from their floor position towards their raised position. As the legs 40 elongate and the retainer 12 is raised, the threaded coupling 12B may be received into and passed through the internal bore of the spider 11. The angle Θ between the control lines 31 and pipe string will increase as the retainer 12, spider 11 and guides 42 are elevated from their floor position (shown in FIG. 1) to a raised position (shown in FIG. 5).

FIG. 5 is a side elevational view of the vertically reciprocating spider assembly 10 with the vertically reciprocating spider retainer 12 supporting the spider 11 in its raised position, thereby providing rig personnel 50 with access to a portion of the length of the outer surface of the pipe string 14 below the retainer 12 and spider 11 and above the rig floor 6 for installing a control line fastener 34. The telescoping legs 40 are shown at their extreme deployed length. The opening formed between adjacent pairs of elongated legs 40 below the retainer 12 and above the rig floor 6 allows rig personnel 50 to install a control line fastener 34. The fastener 34 shown in FIG. 5 is preferably a full-enclosure type that substantially surrounds the entire circumference of the pipe string 14 and secures the control lines 31 along the length of the pipe string 14. A safety retainer 48 may be engaged with one or more of the legs 40 when the retainer 12 is in its raised position (shown in FIG. 5) to prevent inadvertent lowering of the retainer 12 and injury to the rig personnel 50 installing the fastener 34. In its simplest form, this may be half of a pipe, sectioned lengthwise, secured to a leg 40. The installation of the clamps and the implementation of the safety retainer may be manual or automated. Those skilled in the art will appreciate the implementation of a variety of safety devices that may be used to prevent inadvertent collapse or movement of the retainer 12. In some embodiments, such as those having retainers elevated by screw jacks or some types of scissor-lifts, the safety retainer 48 may be either unnecessary or redundant due to the self-locking nature of these devices.

In one embodiment, the opening between the rig floor 6 and the base of the retainer 12 when the retainer 12 is in its raised position is approximately 1.5 to 2 meters (shown in FIG. 5), or just enough to permit rig personnel working on the rig floor 6 to safely and efficiently access a portion of the outer surface of the pipe string 14 at a location below the retainer 12 and above the rig floor 6. Smaller or larger openings may be employed advantageously as dictated by space or other limitations on the rig floor 6. The horizontal spacing between adjacent legs 40 is generally the same whether the retainer 12 is in its floor position (shown in FIGS. 2 and 3) or in its raised position (shown in FIG. 5). This distance may be about one meter or more as desired to provide stability and support for the retainer 12 when in its raised position (shown in FIG. 5).

As shown in FIG. 5, the length of the portion of the pipe string 14 to which rig personnel are given access by elevating the retainer 12 is determined by the stroke of the hydraulically telescoping legs 40. With the pipe string 14 in the position shown in FIG. 5, the clamp 34 may be installed on the pipe string 14 to secure the control lines 31 along the length of the pipe string 14.

The fastener 34 used to secure the control lines 31 to the pipe string 14 may comprise a clamp, clip, spring, wire, strap, band or any fastener or other device that is suitable for securing a control line 31 to the outer surface of an elongated body such as a pipe string 14. Typically, the inside of the fastener 34 is adapted to fit the cylindrical outer surface of the pipe string 14 to which it is secured, and may be configured with one or more "pockets," or circumferentially upset portions, to accommodate and to secure a control line 31 from circumferential and/or axial movement relative to the outer surface of the pipe string 14 to which the control line 31 is secured. Another mechanical fastener, such as a screw, clip, or a bolt and nut, may be employed to close and tighten the fastener 34 in place on the pipe string 14.

Figure 6:
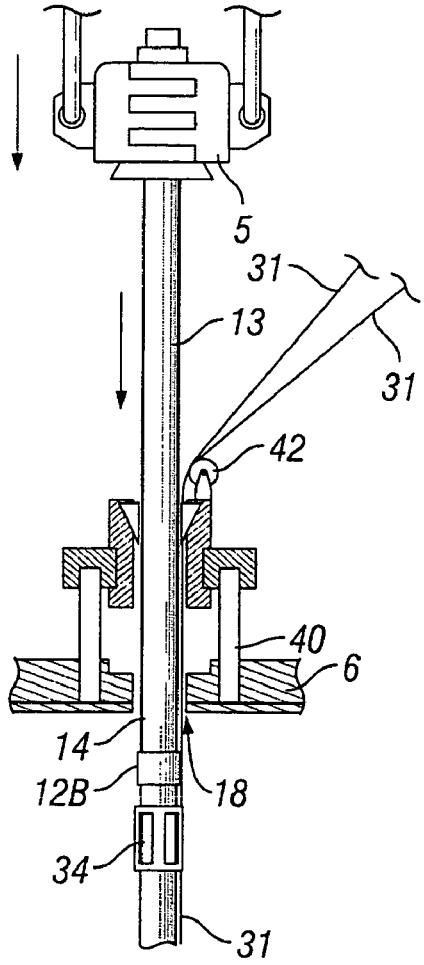
FIG. 6 is a side elevational view of the vertically reciprocating spider assembly of the present invention, with a spider received in a reciprocating retainer, with the installed fastener securing control lines to the outer surface of the pipe string as the pipe string is lowered into the well by the lift elevator and as the retainer and spider are lowered from the raised or elevated position to the floor position.

FIG. 6 shows the vertically reciprocating spider assembly 10 of the present invention, with the installed fastener 34 securing control lines 31 to the outer surface of the pipe string 14 as the pipe string 14 is lowered into the well through the opening 18 in the rig floor 6 as the retainer 12 and spider 11 are lowered from the raised or elevated position (shown in FIG. 5) toward the floor position (shown in FIG. 2). After the fastener 34 is applied and the control line 31 is secured to the pipe string 14, the pipe string 14 and control line 31 are lowered into the well through the opening 18 in the rig floor 6. Additional fasteners 34 may be added with each new joint of pipe that is added to the pipe string 14 or, in the alternative, several joints of pipe may be made up into the pipe string 14 before an additional fastener 34 is installed to secure the control line 31 to the pipe string 14.

For rigs having no top drive, the mast or other structure (not shown) supporting the hydraulic tongs (not shown) used by rig personnel to make up the pipe string 14 may include a pivoting structure that allows the tongs to be pivoted or otherwise removed from the torqueing position. The mast may be pivoted away from the center axis of the pipe string 14 to be removed from the work area in order to prevent interference between the tongs and the retainer 12 as the retainer 12 is moved from the floor position to the raised position shown in FIG. 5, and the mast may be pivotally returned to the torqueing position after the pipe 13 and the pipe string 14 are lowered into the well through the opening 18 and set in the pipe slips 24 for making up an additional joint of pipe 13.

The control line guides 42 may be adapted for controllably imparting a predetermined direction or path to change the position of the control lines 31 relative to the pipe string 14. It may be appreciated that hydraulic, pneumatic or electrical assemblies may be employed for powering or moving the roller guides or other components of the invention. The control line spool (not shown) and the control line guides 42 may be adapted for applying a tensioning force to the control lines 31 and to prevent inadvertent over-reeling from the control line spools.

When the control line 31 comprises a bundle of control lines secured one to the others, the control line bundle may be more stiff and inflexible than a single control line 31. The guides 42 may be adapted to assist in bending and redirecting the control line bundle into a parallel position longitudinally along the outer surface of the pipe string 14 suitable for application of a fastener for securing the bundle to the pipe string 14. It should be recognized that any number of rollers may be used, such as an array of rollers in series forming an arc having an effective diameter that prevents the control line from becoming stressed from sharp bends.

Figure 7A:
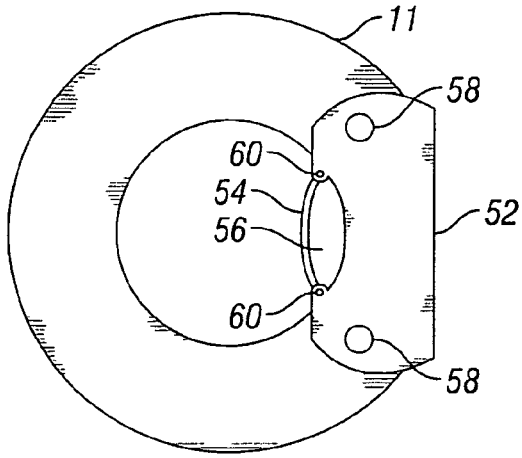
FIG. 7A and FIG. 7B are top schematic views of a spider assembly having a spider door and a control line gate forming a passage to receive control lines.
Figure 7B:
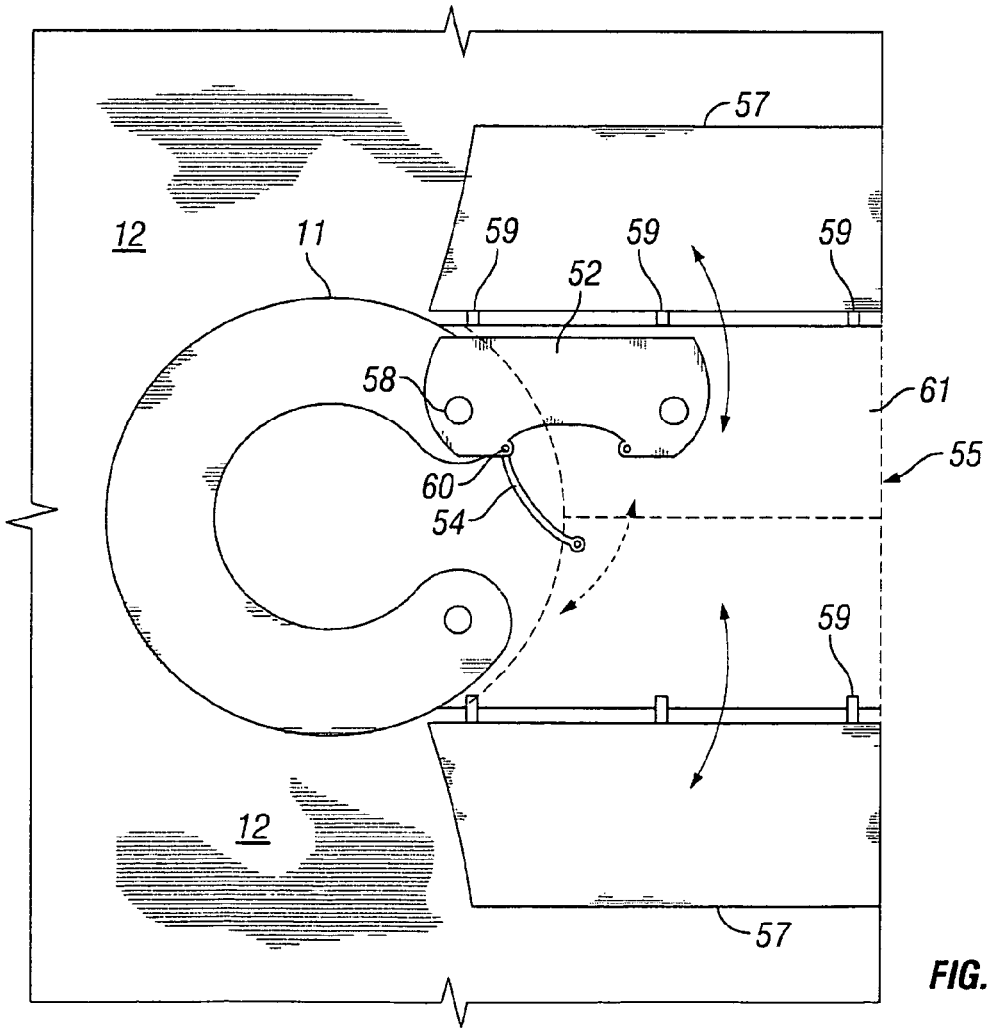

FIG. 7A and FIG. 7B are schematic top views of a spider 11 with a spider door 52 and a control line gate 54 forming a passage 56 to receive control lines. In FIG. 7A, the door 52 is closed and secured to the spider body 11 by pins 58 and the door 52 and gate 54 are secured together by pins 60. Accordingly, the spider door and control line gate are in their proper position for running pipe and control line into or out of the well. In FIG. 7B, the spider 11 has the door 52 in an open, yet secured, condition as a result of removing only one of the pins 58. This allows the spider door to be hingedly opened, as shown. Similarly, a single pin 60 has also been removed to allow the control line gate 54 to hingedly open relative to spider door 52. In this position, a control line can be received between the two members 52, 54. After the control line is positioned between the members, the gate 54 is shut and secured by insertion of the second pin 60 and the spider door 52 is closed and secured by insertion of the second pin 58. It should be recognized that either or both of pins 60 and/or either or both of pins 58 may be removed during the process of receiving or removing a control line. It should also be recognized that the spider door 52 is the robust structural member that bears a load when the spider is supporting the weight of the pipe string. By contrast, the control line gate 54 is a much lighter weight construction intended only to restrict adverse or errant movement of a control line.

Figure 8:
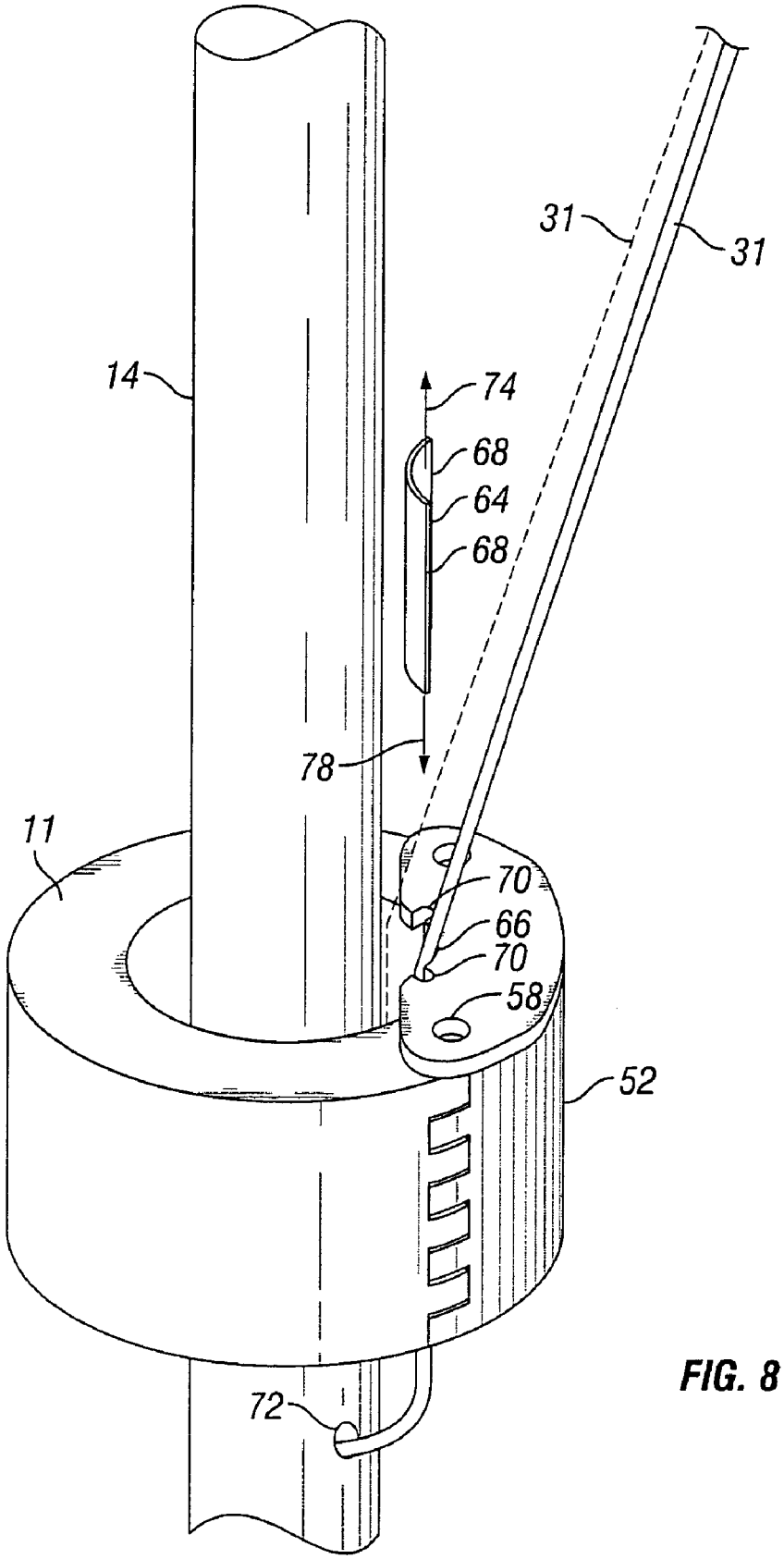
FIG. 8 is a perspective view of a spider assembly with a spider door having a sliding control line gate forming a passage to receive control lines.

FIG. 8 is a perspective view of a spider 11 with a spider door 52 having a control line gate 64 used to form a passage to receive one or more control lines. The control line gate 64 cooperates with the inner surface 66 of the spider door 52 to form the control line passage 56 (see FIG. 9). In the embodiment shown, the control line gate 64 has side edges 68 that are vertically slidably receivable within slots 70 formed in the inner surface 66 of the spider door. It should be noted that one or both of the slots 70 may be formed in the spider body instead of the spider door. It should be noted that a variety of couplings may be used to slidably couple the control line gate to the spider or spider door, including slots, grooves, tracks, and magnets.

In accordance with the present invention, there are three primary methods for positioning a control line within the control line passage that extends through the spider. In all three methods of operation, a section of pipe having an associated downhole device or instrument is secured to the pipe string and the pipe string is supported by a lift elevator. The reciprocating spider is raised and the downhole device and pipe string are lowered further, if necessary, so that the point 72 for terminating a control line to the downhole device is in the access area below the spider 11, but above the rig floor 6. The control line and the terminating point on the downhole device may be connected using any available coupling, such as a threaded coupling. Furthermore, the control line may be of any available type, such as an electrical line or fluid tubing.

In a first method for positioning the control line within the passage, the control line has been connected or terminated to the downhole device prior to the terminating point 72 passing through the spider. The downhole device and pipe string are supported by a lift elevator (not shown) and lowered so that a control line associated with the downhole device is positioned near the spider. The control line gate 64 is vertically slidably removed upwardly out of the slots 70 to provide more room for the control line to pass through the spider. While the pipe gripping members, such as slips, of the spider are disengaged as the pipe is lowered, it may be desirable to generally radially align the terminating point and the control line with the control line passage so that the control line and the coupling are not damaged as they initially pass through the spider. Accordingly, as the pipe string is lowered further, the control line is drawn through the spider and lies along the surface of the downhole device or pipe string. After the terminating point has passed completely through the spider, the control line 31 is drawn generally radially outwardly toward the inner surface 66. Next, the control line gate 64 is vertically slidably replaced downwardly into the slots 70 to form the control passage around the newly introduced control line. Once the control line gate is securely in position, the terminating point is lowered below the rig floor and the spider is lowered to the floor so that normal pipe running operations may continue. It should be noted that to avoid pinching or otherwise damaging the control line, it is important to position all control lines within the control line passage at any time that the gripping members of the spider are being set to grip the pipe. Furthermore, it is preferable to position all control lines within the control line passage as soon as the control line extends through the spider.

The second method includes raising the reciprocating spider and running the terminating point of the downhole device through the spider and into the access area below the spider. The end of the control line is then threaded through the control line passage so that the control line can be terminated to the downhole device in the access area below the spider. In this manner, the control line gate does not require opening or removal. Finally, the terminating point is lowered below the rig floor and the spider is lowered to the floor so that normal pipe running operations may continue.

The third method for positioning the control line within the passage includes raising the spider, lowering the terminating point of the downhole device through the spider, if necessary, and into the access area below the spider, then terminating the end of the control line to the downhole device with the control line extending laterally from a spool. In order to position the control line within the control line passage, it is necessary to open the spider door 52 and remove the control line gate 64 (or open the control line gate 54). After moving the control line into the control line passage, the control line gate is replaced or closed and the spider door is closed. Finally, the terminating point is lowered below the rig floor and the spider is lowered to the floor so that normal pipe running operations may continue.

Therefore, as discussed above, one exemplary method would include the following steps. First, referring to FIG. 8, the control line gate 64 is removed as indicated by the upward arrow 74. Second, the pipe string is advanced downwardly so that the control line source 72 is below the spider 11, as shown. Next, the control line is positioned into the control line sleeve by drawing the control line in the direction of the outward arrow 76. Finally, the control line gate 64 is replaced as indicated by the downward arrow 78. The pipe string may then be run further into the well and the spider set in preparation for adding additional pipe sections or stands to the pipe string. The control line may be clamped to the pipe string below the spider at appropriate points according to the previous discussion.

Figure 9:
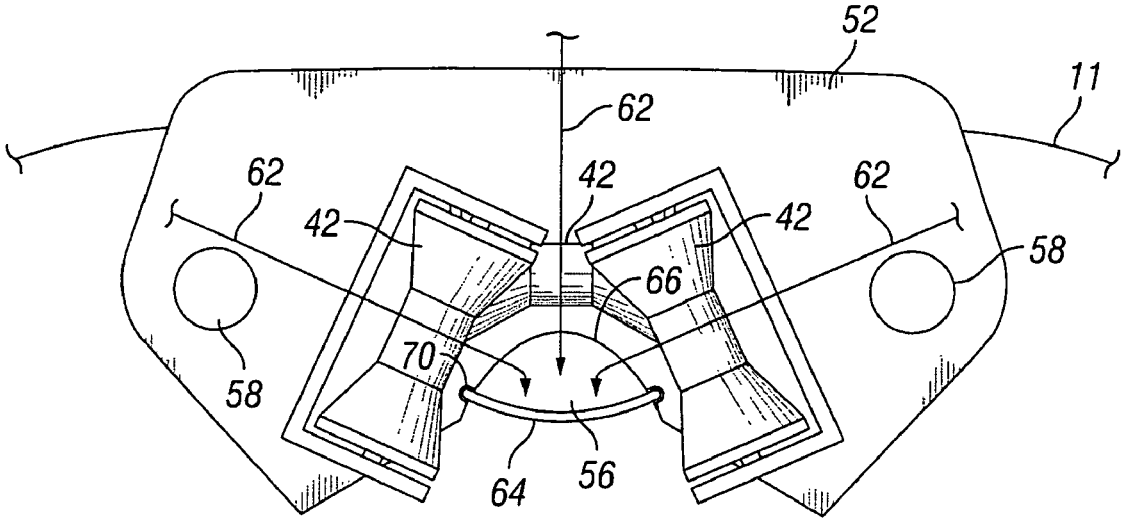
FIG. 9 is a top schematic view of control line guides positioned on the spider door and generally aligned to direct the pathway of control lines over the control line guides and into the passage between the spider door and the control line gate.

FIG. 9 is a schematic top view of a control line guide comprising three guide rollers 42 positioned above the spider door 52 and generally aligned to direct control lines over the rollers 42 and into the control line passage 56 formed between the control line gate 64 and the inner surface 66 of the spider door. The control lines may follow any one or more of the paths shown schematically by arrows 62. Further, the control lines may enter from almost any radial angle toward the sleeve 56.

The terms "comprising," "including," and "having," as used in the claims and specification herein, shall indicate an open group that may include other elements not specified. The term "consisting essentially of," as used in the claims and specification herein, shall indicate a partially open group that may include other elements not specified, so long as those other elements do not materially alter the basic and novel characteristics of the claimed invention. The terms "a," "an," and the singular forms of words shall be taken to include the plural form of the same words, such that the terms mean that one or more of something is provided. For example, the phrase "an assembly having a control line guide" should be read to describe an assembly having one or more control line guide. The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used in the specification to indicate that an item, condition or step being referred to is an optional (not required) feature of the invention.

While a preferred form of the present invention has been described herein, various modifications of the apparatus and method of the invention may be made without departing from the spirit and scope of the invention, which is more fully defined in the following claims.

What is claimed is:

1. An apparatus for installing a control line and a pipe string in a well, comprising:

a retainer for reciprocating a spider, wherein the spider can reciprocate without movement of an elevator for supporting the pipe string; and a control line guide disposed through the spider outside the path of pipe gripping members within the spider, wherein the control line guide is aligned to supply the control line along the pipe string.

2. The apparatus of claim 1 further comprising a plurality of members for supporting the retainer in a raised position above a rig floor.

3. The apparatus of claim 2 further comprising a means of raising the spider to its raised position.

4. The apparatus of claim 2 wherein a gap is created for providing access to at least a portion of the pipe string beneath the spider in its raised position and above the rig floor for securing the control line to the pipe string.

5. The apparatus of claim 1, further comprising a control line sleeve extending along the pipe string outside the path of the pipe gripping members for protecting the control line against pinching and abrasion.

6. The apparatus of claim 1, wherein the spider comprises a spider door forming a control line passage.

7. The apparatus of claim 6, wherein the spider door comprises a selectively securable control line gate forming the control line passage therebetween.

8. The apparatus of claim 6, wherein the spider door comprises a vertically removable control line gate.

9. The apparatus of claim 8, wherein the control line gate is slidably received within vertical slots in the inner surface of the spider door.

10. A method of installing control line and a pipe string in a well, comprising:

transferring support of the pipe string from a spider to an elevator;

reciprocating the spider between a floor position and a raised position while the pipe string is supported by the elevator; and providing the control line to the pipe string through a control line passage within the spider and outside the path of pipe gripping members within the spider.

11. The method of claim 10, further comprising disengaging the spider from the pipe string prior to raising the spider to its raised position.

12. The method of claim 10, wherein the spider is not engaged with the pipe string during the step of reciprocating.

13. The method of claim 10, further comprising:

opening the control line passage;

disposing the control line into the control line passage; and closing the control line passage.

14. The method of claim 13, wherein the steps of opening and closing are performed with a vertically removable control line gate.

15. The method of claim 10 further comprising supporting a pipe string with an elevator, wherein the spider is supportable in its raised position only when the pipe string is supported by the elevator.

16. The method of claim 10 further comprising raising the spider to the raised position only when the spider is disengaged from the pipe string.

17. The method of claim 15, further comprising lowering the spider to the rig floor and then reengaging the spider with the pipe string.

18. The method of claim 10, further comprising:

moving a power tong away from the pipe string when the power tong is not in a working position.

19. A method for securing a control line to a pipe string being run into a well comprising:

transferring support of the pipe string from a spider to an elevator;

raising the spider above a rig floor;

supplying a control line through a control line passage between adjacent pipe gripping members in the spider to the pipe string at a location below the spider and above the rig floor;

securing the control line to the pipe string below the spider and above the rig floor; and lowering the pipe string and the control line into the well.

20. The method of claim 19, further comprising:

opening the control line passage;

disposing the control line into the control line passage; and closing the control line passage.

21. The method of claim 20, wherein the steps of opening and closing are performed with a vertically removable control line gate.

* * * * *